US006209686B1

(12) United States Patent
Tomasetti et al.

(10) Patent No.: US 6,209,686 B1
(45) Date of Patent: Apr. 3, 2001

(54) CAR STRUCTURE

(75) Inventors: Fabrice Tomasetti, Wittenheim; Michel Boigues, Rixheim, both of (FR)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 09/352,274

(22) Filed: Jul. 13, 1999

(30) Foreign Application Priority Data

Jul. 13, 1998 (EP) ..... 98 810661

(51) Int. Cl.[7] ..... B66B 11/02
(52) U.S. Cl. ..... 187/401
(58) Field of Search ..... 187/401, 406, 187/409, 414; 52/588.1, 30, 506.5, 506.6

(56) References Cited

U.S. PATENT DOCUMENTS

| | | | | |
|---|---|---|---|---|
| 600,759 | * | 3/1898 | Williams et al. | 187/401 |
| 2,246,732 | * | 6/1941 | Hymans | 187/401 |
| 3,707,205 | | 12/1972 | Gibson . | |
| 4,361,208 | * | 11/1982 | Jackson et al. | 187/401 |
| 4,699,251 | * | 10/1987 | Orndorff et al. | 187/401 |
| 4,700,809 | | 10/1987 | Lazar . | |
| 5,018,602 | * | 5/1991 | Salmon et al. | 187/401 |
| 5,564,529 | * | 10/1996 | Ericson et al. | 187/401 |
| 5,581,057 | | 12/1996 | Ferrario et al. . | |
| 5,975,249 | * | 11/1999 | Tomaseti | 187/401 |

FOREIGN PATENT DOCUMENTS

| | | | | |
|---|---|---|---|---|
| 94 05 750 | | 7/1994 | (DE) . | |
| 566 424 | | 10/1993 | (EP) . | |
| 2 673 887 | | 9/1992 | (FR) . | |
| 2 740 763 | | 5/1997 | (FR) . | |
| 496286 | * | 4/1977 | (GB) | 187/401 |
| 2 139 183 | | 11/1984 | (GB) . | |
| 52-47246 | * | 4/1977 | (JP) | 187/401 |
| 52-55145 | * | 5/1977 | (JP) | 187/401 |
| WO 96/16893 | | 6/1996 | (WO) . | |

* cited by examiner

*Primary Examiner*—Robert P. Olszewski
*Assistant Examiner*—Thuy V. Tran
(74) *Attorney, Agent, or Firm*—Cohen, Pontani, Lieberman & Pavane

(57) ABSTRACT

A car structure for an elevator car, having two robust frame elements which bound the enclosure of the elevator car. A support structure and two crosspieces join the frame elements to form a framework which stiffens the elevator car. The frame elements support the upper guide shoes. The lower guide shoes being fastened to the side plates of the supporting structure together with the safety gears. Wall elements fastened to the frame elements, a floor plate resting on the supporting structure and having a floor element, and a ceiling plate fastened to the frame elements, form the shell of elevator car. The instruments and the mechanical and electrical subassemblies required for an elevator car ready for operation can be fastened to the frame elements, which serve as mountings, and to the ceiling plate.

5 Claims, 4 Drawing Sheets

CAR STRUCTURE

SUMMARY OF THE INVENTION

1. Field of the Invention

The present invention relates to the car structure for an elevator car, which includes wall, floor, and ceiling elements forming an enclosure, and a supporting structure which supports the enclosure. The enclosure and the supporting structure, together with functional subassemblies, form an elevator car ready for operation.

2. Discussion of the Prior Art

Constructing the parts of an elevator car forming an enclosure from wall, floor, and ceiling parts capable of being assembled together, and placing such an enclosure in a sling which surrounds this enclosure, is known. Guide shoes or roller guides, together with a safety gear, are then fastened to this sling.

A solution of this type is known from U.S. Pat. No. 4,700,809. Laterally connected wall elements, a floor frame, and a ceiling element are held together and supported by a sling. To strengthen and stiffen the car body, which is made from bent metal sheet, the sling must be relatively heavily and robustly constructed.

Constructions are also known in which the supporting parts are formed from individual wall elements, which extend upwards and downwards and are fitted with guiding elements.

A solution of this type is known from French reference FR 2 740 763. Above and below the car body, extended wall elements are connected together by means of crosspieces, which form an upper yoke and a lower yoke, the extended wall elements serve to support the guide shoes and a safety gear. With this type of car construction there are no further elements to stiffen the car. According to experience, it is necessary to take extensive measures to damp vibrations on cars of this type.

SUMMARY OF THE INVENTION

The object of the present invention is therefore to create a car structure for an elevator car which has compact dimensions and great rigidity, as well as being simple and inexpensive to install.

The car structure according to the present invention includes frame elements (also referred to herein as frame stiffeners or closed rectangular frame stiffeners) to accommodate wall, floor, and ceiling elements, and which are connected by direct mechanical means to the supporting construction. The frame elements and the ceiling element are made in such a manner as to be able to accommodate functional subassemblies. As a result, fewer auxiliary parts such as mounting plates and brackets are needed for installation, and fitting out the car structure with all the internal and external fixtures and fittings to make it into a ready-to-use elevator car requires less outlay in terms of time and cost.

The frame subassemblies, which take the form of prefabricated frame elements, are supported by a supporting structure which also carries the car floor. The supporting structure mentioned forms an integral part of the car structure.

The supporting structure has side parts which have special constructions to accommodate and support the frame elements, and which also accommodate the guide shoes and the safety gear. This advantageous form of the supporting structure facilitates accommodation and fastening of the frame elements and thereby also the installation of the car structure.

The frame elements and the supporting structure, together with two crosspieces on the upper side, form a framework which stiffens and strengthens the car body.

As a result of the rigidity achieved in this manner, the car structure according to the invention is self-supporting. This makes it possible in one of the preferred embodiments for a fastening point for a suspension rope to be positioned on a crosspiece of the supporting structure at its back end, as a result of which the elevator car can travel to at least the same height as an upper return pulley.

As a result of the rigidity of the frame elements, in a further preferred embodiment as a cantilever car, they can carry upper guide shoes in a simple manner by means of extensions.

Wall elements can be fastened directly to and/or between the frame elements without auxiliary parts, and in some cases also to the floor element and to crosspieces.

The car floor construction consists of a lower floor plate on which is laid a floor element with holes in it. The holes in the floor element serve to save weight and give rigidity, the latter increasing the lifting capacity at the same time. A floor covering can be laid directly on the perforated plate.

As a result of the manner of construction of the upper parts of the frame, and of the crosspieces, a ceiling plate which closes off the car body at the top can be fastened directly to them. The cover plate also has all necessary holes drilled in it to receive ceiling and car-roof instruments.

The frame elements have a large number of mounting holes, which make it possible to join the elements to other components, and to attach further instruments and functional subassemblies, such as door drive, door panel, door guide, door sill, toe guard, display, call buttons, lighting, ceiling elements, inspection control station, and other similar items, at the job site without the need for additional processing and auxiliary parts.

The elevator car according to the invention can take the form of a cantilever car with a side entrance.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
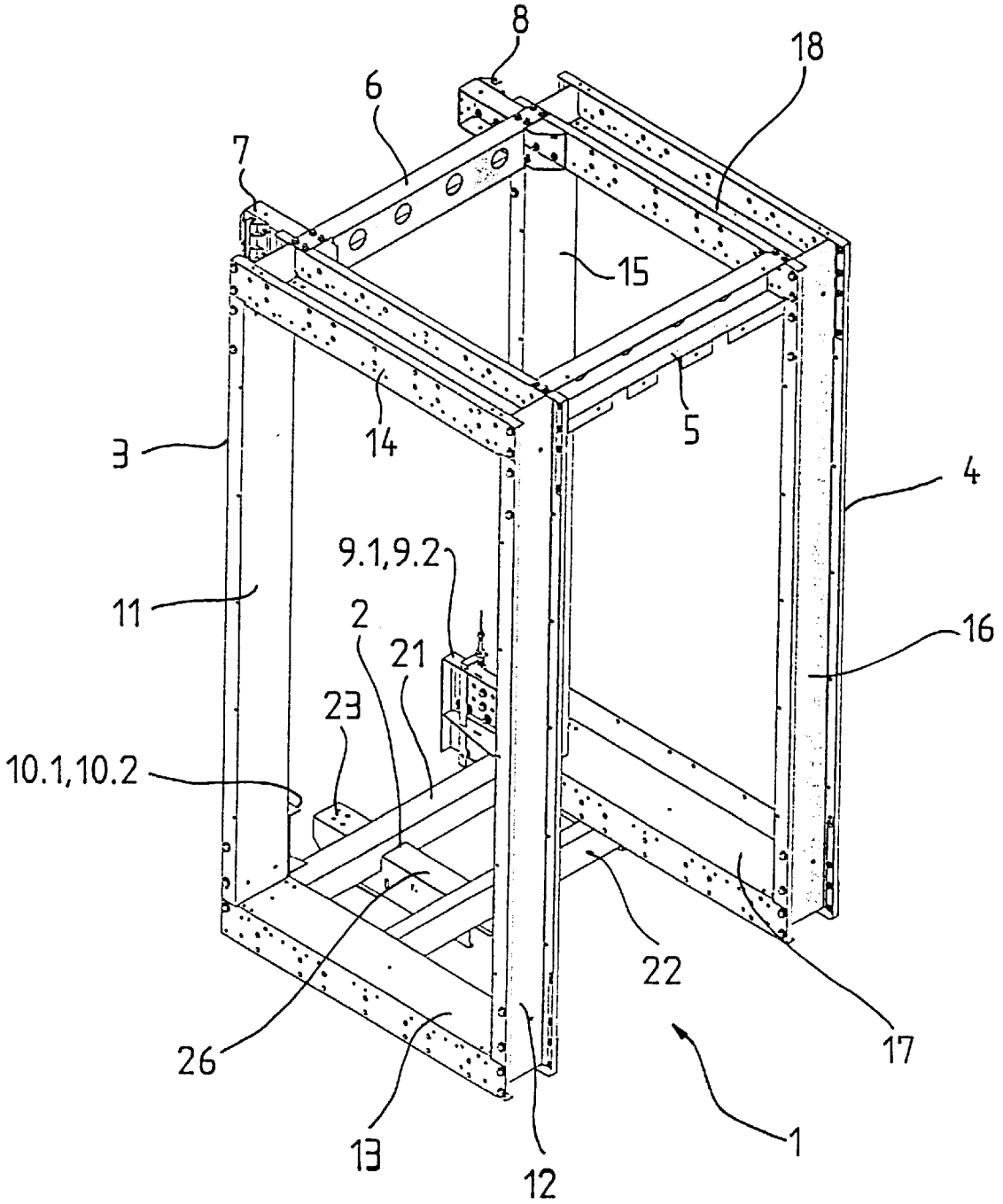
FIG. 1: The assembled supporting and strengthening framework of the inventive car structure.

The car structure 1 illustrated in FIG. 1 consists essentially of a multi-part supporting structure 2. Two closed rectangular frame stiffeners 3, 4 in the form of side frames are fastened laterally to the supporting structure 2. The closed rectangular frame stiffeners 3, 4 are fastened to each other horizontally at one upper corner with a crosspiece 5, and at the other upper comer with a crosspiece 6. Each closed rectangular frame stiffeners 3, 4 consists of essentially U-shaped sheet metal sections with multiple bends and having a large number of mounting holes. Pre-drilling the mounting holes makes it possible to fasten further parts onto the frame sections at the job site without further processing. The closed rectangular frame stiffeners 3, 4 consist of lower horizontal frame profiles 13, 17, left-side vertical frame profiles 11, 15, right-side vertical frame profiles 12, 16, and upper horizontal profiles 14, 18. The frame profiles 11–18 are fastened to each other at the comers by means of screws, bolts, or rivets. The upper horizontal crosspieces 5, 6 are also fastened to the upper frame sections 14, 18 by means of screws, bolts, or rivets, and also have bolted on to them an extension onto which upper guide shoes 7, 8 are fastened.

On the multi-part supporting structure 2, 22 indicates a first, front crosspiece, 21 a second, rear crosspiece, and 26 a central crosspiece which supports the crosspieces 21 and 22. The central crosspiece 26 extends past the second crosspiece 21, and has on this extension a rope support fixture 23 for a suspension rope. The two additional parts of the supporting structure 2 which project in the same direction as the extension of the crosspiece 26, and which are only partly visible, support the guide shoes 9.1, 10.1 and the safety gears 9.2, 10.2.

Figure 2:
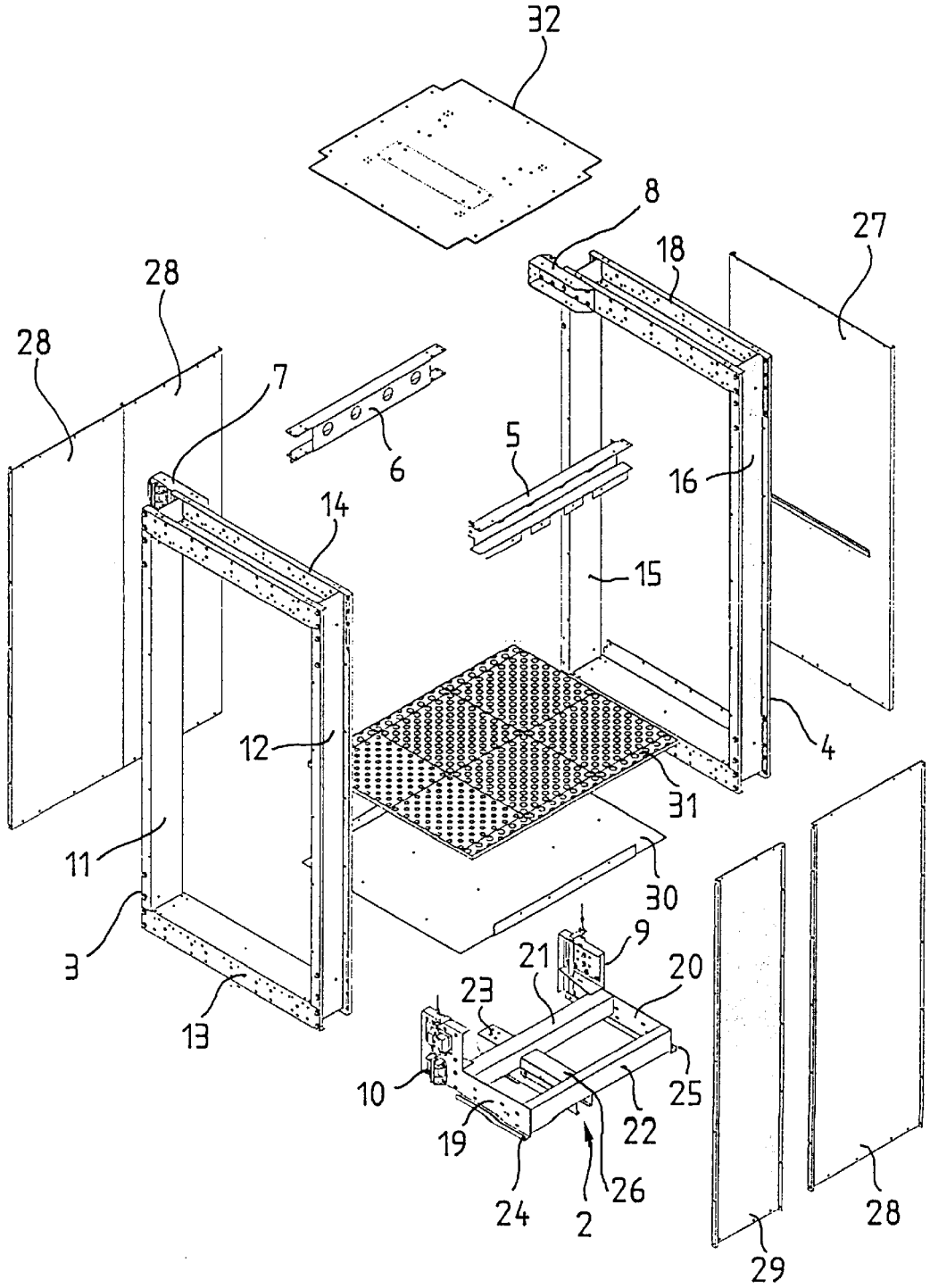
FIG. 2: All parts of the elevator car arranged three-dimensionally.

The further details of the supporting structure 2, together with additional elements of the car structure 1, can be seen in FIG. 2. Onto the end faces of the crosspieces 21, 22 of the supporting structure 2 are fastened guide shoe supports plates 19, 20. These carry on their extensions the safety gears 9.2, 10.2 mentioned above, together with the guide shoes 9.1, 10.1. In addition, the guide shoe supports 19, 20 each have on their lower edge a U-shaped channel 24, 25 for direct mechanical connection to, and support of, the closed rectangular frame stiffeners 3, 4. In the illustrated embodiment, the supporting structure 2 is a completely prefabricated subassembly including the safety gears 9.2, 10.2 and the guide shoes 9.1, 10.1.

As a base for the car floor covering which will be installed later, between the closed rectangular frame stiffeners 3, 4 there is a floor plate 30 which rests on the supporting structure 2 and has lying on it a perforated floor element 31. The floor element 31 serves as an isolating inner layer and as a stiffener for the car floor. The car structure 1 is closed at its upper end by a ceiling plate 32, which also has ready-drilled mounting holes in it for fastening ceiling elements and roof instruments.

The back wall is formed by a wall element 27 which is fastened to the right-hand closed rectangular frame stiffeners 4. The left-hand side wall is formed by two identical wall elements 28 which are joined together to form a whole, and placed against the vertical frame sections 11, 15 and fastened to them. To form the right-hand car wall there is an identical wall element 28 and a further, narrower wall element 29, and these are placed against and fastened to the vertical frame sections 12, 16 in the same way. When the car structure I is finally fitted out, the space remaining between the wall element 28 and the wall element 29 is taken up by the wall element of an operating panel, which is not present here.

Figure 3:
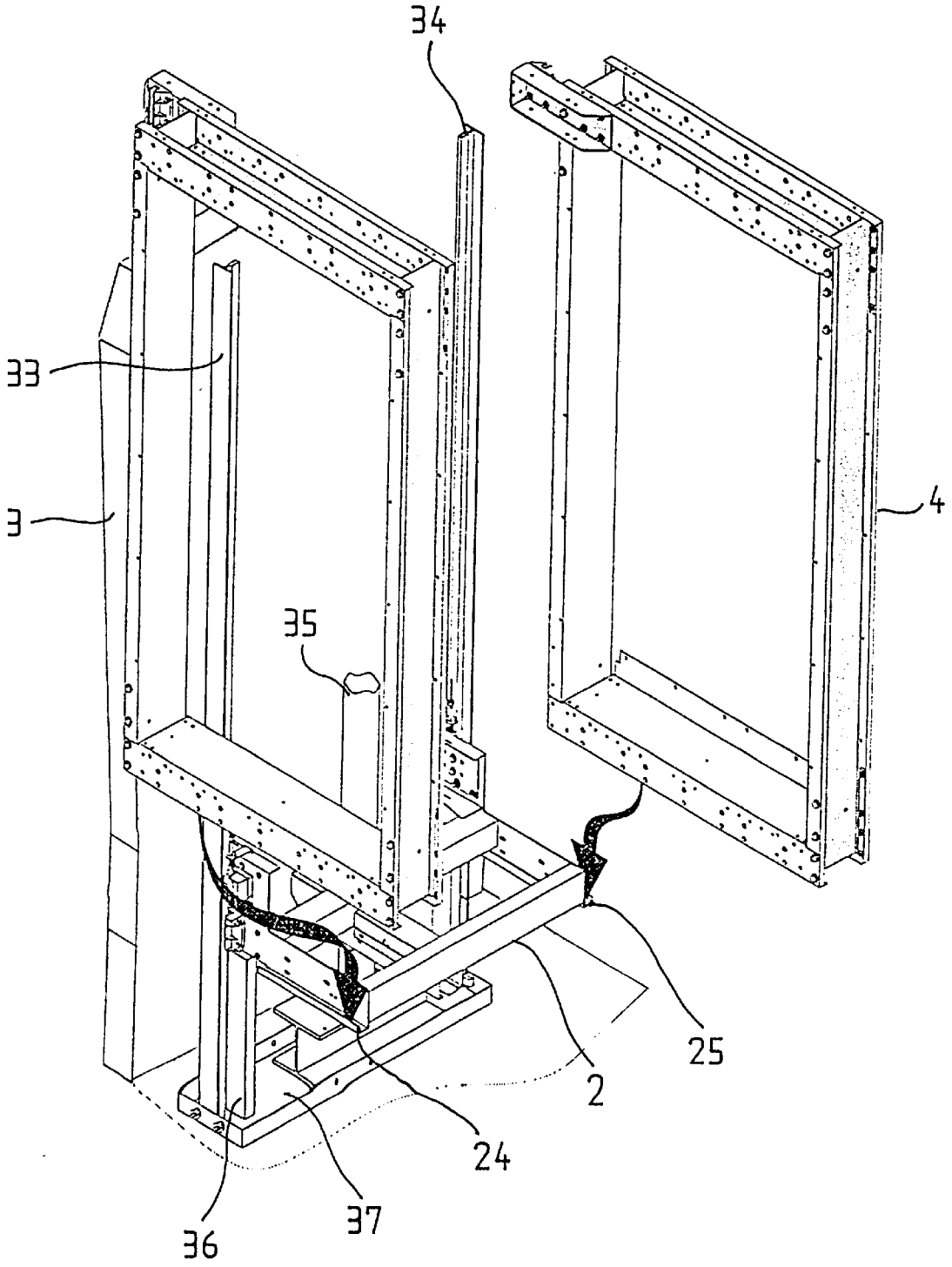
FIG. 3: An illustration showing assembly of the frame elements on the supporting structure.

FIG. 3 illustrates an important step in the assembly at a job site of the car structure 1 according to the invention. An elevator hoistway has guides 33, 34, which stand on a base plate 37. On this base plate 37 a hydraulic jack 35 is also partially indicated in outline. The supporting structure 2 has already been put into position and rests on temporary installation supports 36 at each end. The next step is for the two prefabricated closed rectangular frame stiffeners 3, 4 to be inserted into the hoistway and lowered onto the supporting channels 24, 25, and then fastened at the top to the upper crosspieces 5, 6. After this installation step, the car structure 1 as shown in FIG. 1 is ready for the fitting, or attachment, of the wall elements 27-29, the floor plate 30 with the floor element 31, and the ceiling plate 32. If it appears expedient for reasons of accessibility, the wall element 27 can already be fastened to the rear closed rectangular frame stiffeners 4 before it is installed. After all structural parts have been installed, the car structure 1 can be fitted with the usual instruments and apparatus mentioned earlier, and brought into the condition of an elevator car ready for operation. As already stated, this does not require any further work on any construction parts whatever, because the mounting holes for all planned equipment variants are prefabricated and present in all parts of the structure.

Figure 4:
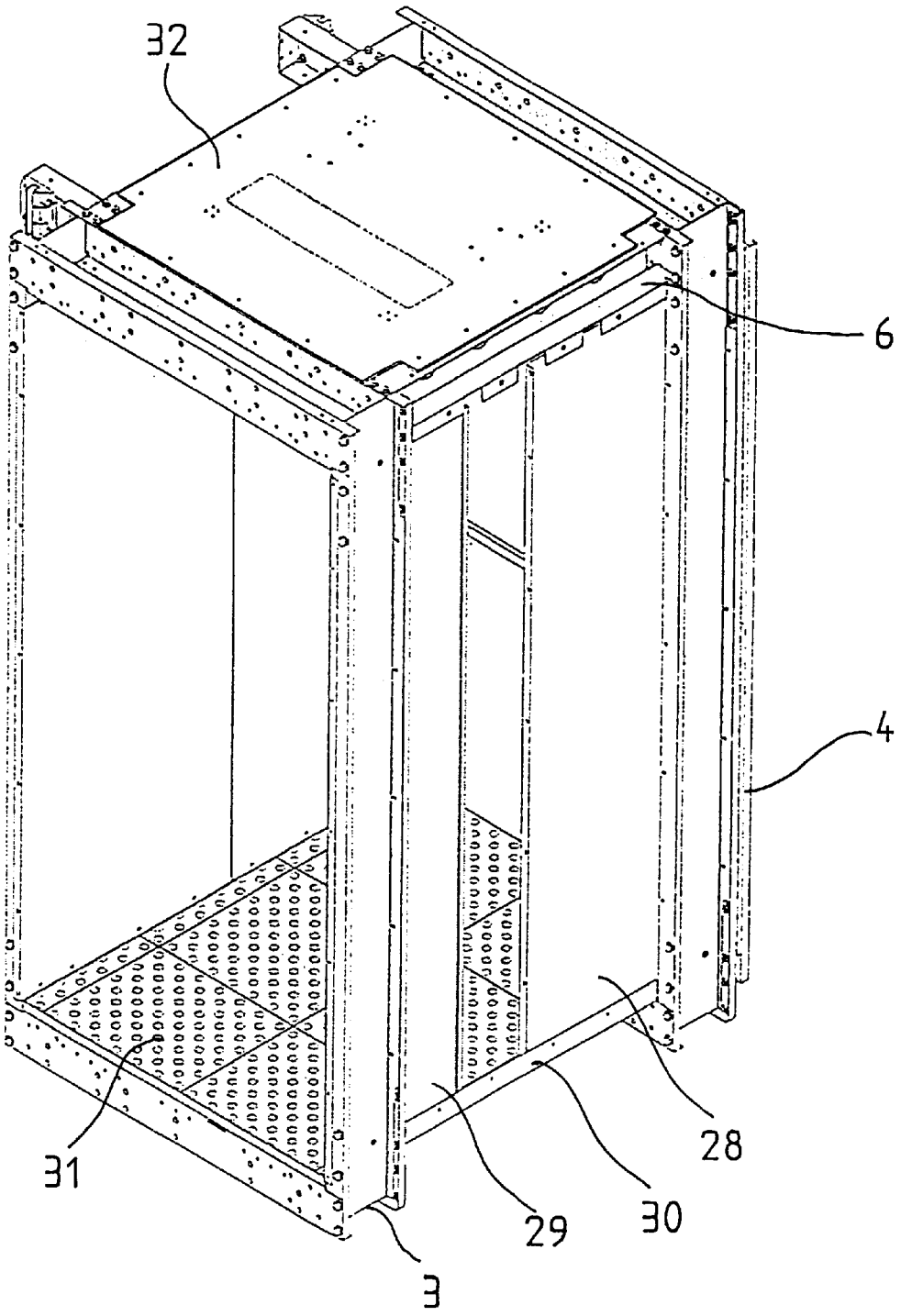
FIG. 4: An illustration of the car shell ready for fitting out.

FIG. 4 illustrates the finished car shell. On the front of the open side which forms the entrance, the drilled holes for mounting the door apparatus and a toe guard can be seen, and the space in the right-hand wall will, as already mentioned, be filled by an operating panel wall element which is not shown. This wall element contains the necessary call and command emitters, and various switches and displays, and can accommodate further optional accessory equipment. The wall elements 27–29 can be made from steel sheet with a ready-to-use surface, or from suitable sheets of composite material. To fasten them to the closed rectangular frame stiffeners 3, 4, to the crosspieces 5, 6, and to the floor plate 30, screws or clips can be used.

The car structure 1 according to the invention is designed as a cantilever car with guides positioned at the side. This layout achieves an optimal relationship between car depth and car width, and an optimal overhang beyond the guide plane, and in consequence the lateral load on the guide shoes 7, 8, 9.1 and 10.1 is kept within acceptable limits even with a deep car.

The parts of the car structure 1 are preferably manufactured from steel plate of appropriate thickness and quality. However, to reduce weight, light metals can also be used for most parts of the structure. For fastening the parts of the structure together, it is foreseen that for preference screws or bolts will be used for detachable connections. For this purpose, where there is sufficient thickness of material, drilled mounting holes can already be provided with threads. The open shape of the section of the frame parts 11–18, and of the crosspieces 5, 6, allow access to the joins from both sides, so that bolts with nuts and washers can also be used. The frame parts 11–18, the crosspieces 5, 6, the floor plate 30, and the ceiling plate 32 have dimensions which provide sufficient strength and rigidity for them to serve as solid supports for all the instruments and mechanical subassemblies fastened to them.

The invention is not limited by the embodiments described above which are presented as examples only but can be modified in various ways within the scope of protection defined by the appended patent claims.

We claim:

1. A self-supporting elevator car structure for a cantilever-type elevator system in which a car is movable along two vertical guide rails which are placed in a hoistway to one side of the car and the car is eccentrically suspended by hoisting ropes which are attached to a rope support fixture protruding from the one side of the car, the car structure comprising:

two closed rectangular frame stiffeners arranged in two planes which lie parallel to the guide rails and orthogonally to a plane between the rails so as to form a front frame and a back frame of the car, the closed rectangular frame stiffeners each having a lower horizontal frame profile;

a supporting structure arranged as a junction between the lower horizontal frame profiles of the two closed rectangular frame stiffeners, the rope support fixture being arranged on the supporting structure so as to laterally protrude therefrom;

floor elements, a ceiling element and side-wall elements mounted to the rectangular frame stiffeners so as to form an enclosure; and lower and upper guide shoe supports joined to the closed rectangular frame stiffeners and equipped with guide shoes for guiding the car on the guide rails, the closed rectangular frame stiffeners being rated so as to provide the car with stability so as to withstand a cantilever effect and thereby avoid a need for additional reinforcement means.

2. A car structure according to claim 1, wherein the closed rectangular frame stiffeners are configured so as to form stable bases on which one of car doors and car door components are attachable.

3. A car structure according to claim 1, and further comprising lower guide shoes and safety gears fastened to the lower guide shoe supports.

4. A car structure according to claim 1, wherein the closed rectangular frame stiffeners comprise vertical frame elements, said wall elements being fastenable one of to inner surfaces of the vertical frame elements of a single closed rectangular frame stiffener and between two closed rectangular frame stiffeners.

5. A car structure according to claim 1, wherein the rectangular frame stiffeners are constructed so as to form mountings on which instruments and mechanical and electrical functional subassemblies are fastenable.

* * * * *